United States Patent [19]

Kolton et al.

[11] Patent Number: 4,759,440

[45] Date of Patent: Jul. 26, 1988

[54] HANGER FOR SUSPENDERS WITH TROUSER SNAPS

[75] Inventors: Chester Kolton, Westfield; Stuart S. Spater, Livingston, both of N.J.

[73] Assignee: B&G Plastics, Inc., New York, N.Y.

[21] Appl. No.: 49,794

[22] Filed: May 15, 1987

[51] Int. Cl.[4] ..... A47G 25/36; A47G 25/48

[52] U.S. Cl. ..... 206/296; 206/278; 223/85; 211/113; D6/315; D6/326; 40/322

[58] Field of Search ..... 223/DIG. 1, 85, 87; 211/13, 113; 206/278, 296; 40/322; D6/315, 326

[56] References Cited

U.S. PATENT DOCUMENTS

| | | | |
|---|---|---|---|
| D. 151,572 | 10/1948 | Tomarin | 223/DIG. 1 X |
| D. 182,259 | 3/1958 | Tupper | 223/DIG. 1 X |
| 2,099,596 | 11/1937 | Bruening | 223/87 |
| 2,401,835 | 6/1946 | McFall | 223/DIG. 1 X |
| 2,605,000 | 7/1952 | Tomarin | 211/113 |
| 3,136,419 | 6/1964 | Ruderian | 223/87 X |
| 3,243,087 | 3/1966 | Pulitzer | 223/87 |
| 3,398,867 | 8/1968 | Taylor et al. | 223/87 |
| 3,710,996 | 1/1973 | Smilow et al. | 223/87 |
| 3,900,181 | 8/1975 | Pitanis | 223/87 X |

*Primary Examiner*—Robert R. Mackey

*Attorney, Agent, or Firm*—Robin Blecker & Daley

[57] ABSTRACT

A hanger for the hanging of suspenders of the type having snap means in first open state for receiving the waistband of trousers and in second closed state for closure retentively upon the waistband comprises an integral body having a first portion for engaging a display rod, and a second portion depending from the first portion and defining at least one pair of openings therethrough, each such opening being bounded in first part by continuous wall structure of the body and in second part by a discontinuity in the body providing a passage into the opening, first and second segments of the wall structure respectively aside the passage being mutually deflectable, permitting the receipt in the opening of the suspender snap means in such closed state thereof.

8 Claims, 4 Drawing Sheets

HANGER FOR SUSPENDERS WITH TROUSER SNAPS

FIELD OF THE INVENTION

This invention relates generally to hangers for the hanging of suspenders and pertains more particularly to hangers for the hanging of suspenders of the type having snaps adapted to receive and retentively close upon a trouser waistband.

BACKGROUND OF THE INVENTION

Copending applications of applicants herein, Ser. Nos. 882,486, now U.S. Pat. No. 4,714,156, and 882,487, now U.S. Pat. No. 4,718,546, both filed on July 7, 1986 and commonly assigned herewith, address the hanging of suspenders of the type having stems with slots therein for receiving buttons disposed interiorly on a trouser waistband. Both such hangers are in the form of a flat body having a hook portion upwardly of suspender stem engaging structure. In the former patent application, the hanger has a pair of openings extending therethrough and an elongate member is cantilever-supported in each such opening and configured compatibly with a suspender stem and its button slots to retain the stem by releasable engagement with both slots thereof. In the latter patent application, the hanger has a pair of foldable straps dependent therefrom, each strap being configured compatibly with a suspender stem to receive and retain both slotted ends thereof.

Another type of suspenders is known in the art, namely of the type having stems equipped with snaps adapted to receive and retentively close upon the waistband of trousers, without need for the trouser waistband to have suspender buttons. This type of suspenders is quite popular, since many trousers do not come equipped with such suspender buttons.

The snap type suspender presents a display problem not faced in connection with the previously described suspender. Thus, such snaps are desirably closed at the point of manufacture to facilitate shipment thereof without suspenders becoming entangled with one another. This is in contrast to the stem/slot type of suspenders, which are shipped with stem slots free but not likely to give rise to suspenders entanglement. Since heretofore known hangers are not adapted at all to the retention of the snaps of snap type suspenders in closed state, they do not afford a solution to the problem presented at the point of manufacture as it impacts on display at the point of sale. Opening and closing suspender snaps to effect display is of course not a meaningful solution since it consumes labor and is inefficient.

SUMMARY OF THE INVENTION

The present invention has as a primary object thereof the provision of improved hangers for suspenders.

A particular object of the invention is to provide hangers for the hanging of suspenders of the type having snaps adapted to receive and retentively close upon a trouser waistband.

It is a more particular object of the invention to provide hangers for the hanging of snap type suspenders at the point of sale, without need for opening of the snaps thereof.

In the attainment of the foregoing and other objects, the invention provides a hanger for the hanging of suspenders of the type having snaps which, in first state, are open to receive the waistband of trousers, and, in second state, are closed retentively upon such waistband. The hangers of the invention comprise an integral body of such a resilient synthetic material having a first or upper, hook portion for engaging a display rod, and a second or lower portion, depending from the first portion and defining at least one pair of openings therethrough, each bounded in first part by continuous wall structure of the integral body and in second part by a discontinuity in the hanger body providing a passage into such opening. First and second segments of the wall structure respectively aside the passage are mutually deflectable, permitting the receipt in such opening of a suspender snap in such closed state thereof, and are then reversely deflectable to retain the snap.

Typically, each snap has first and second closable jaws on the interior of each of which is secured a resilient pad which frictionally engages the trouser waistband. Each hanger opening is sized to receive and circumscribe the resilient pads of a snap.

In a preferred embodiment, the hanger openings are generally rectangular and the resilient pads are circular, the lower wall structure of the hanger body bounding such openings having horizontal segments mutually horizontally deflectable for such receipt in the opening of the pads in the snap closed state.

A particularly preferred embodiment of the invention calls for an asymmetrical relation rectilinearly as between such horizontal segments of the lower wall structure, for purposes discussed below.

The foregoing and other objects and features of the invention will be further understood from the following detailed description of preferred embodiments thereof and from the drawings wherein like reference numerals identify like parts throughout.

DESCRIPTION OF PREFERRED EMBODIMENTS AND PRACTICES

Figure 1:
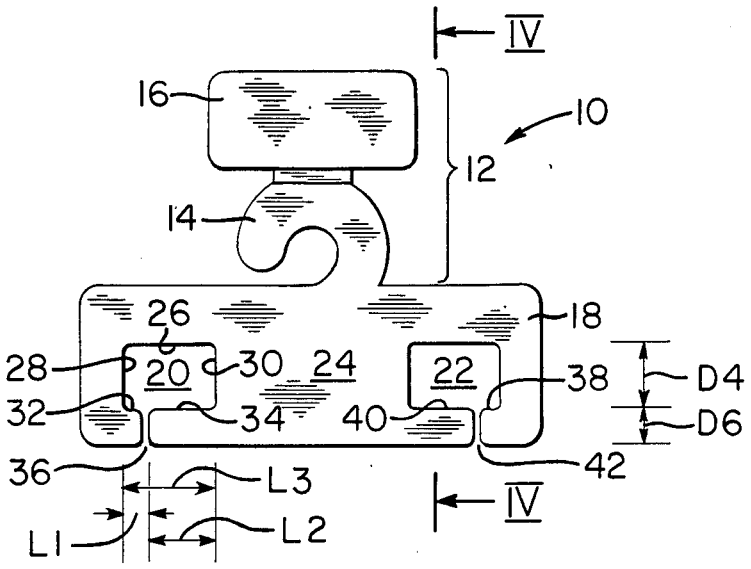
FIG. 1 is a front elevational view of a first embodiment of the hanger of the invention.
Figure 2:
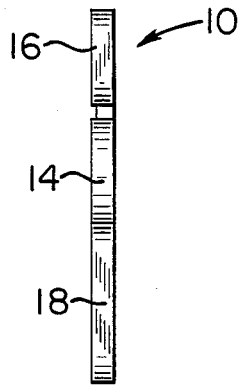
FIG. 2 is a side elevational view of the FIG. 1 hanger.
Figure 3:
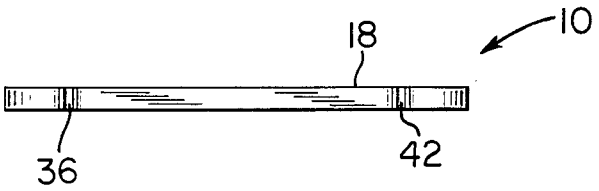
FIG. 3 is a bottom plan view of the FIG. 1 hanger.
Figure 4:
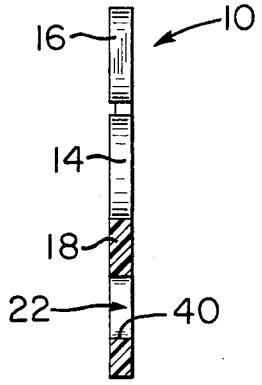
FIG. 4 is a sectional view of the FIG. 1 hanger as would be seen from plane IV—IV of FIG. 1.

Referring to FIGS. 1 through 4, hanger 10 is an integral body comprised of resilient synthetic material having a first or upper portion 12 inclusive of a hook 14 and a logo display area 16. A second or lower hanger portion 18 depends from upper portion 12 and is of generally rectangular configuration with its longer dimension horizontal. Openings 20 and 22 are provided through portion 18 aside a central expanse 24 thereof. Considering opening 20, it is bounded in first part by continuous wall structure of the hanger body, including top wall 26, sidewalls 28 and 30 and bottom wall segments 32 and 34, and in second part by a hanger body discontinuity, providing passage 36 into opening 20 and separating bottom wall segments 32 and 34. Like boundary definition exists for opening 22, with bottom wall segments 38 and 40 having passage 42 therebetween providing access to opening 22.

Figure 8:
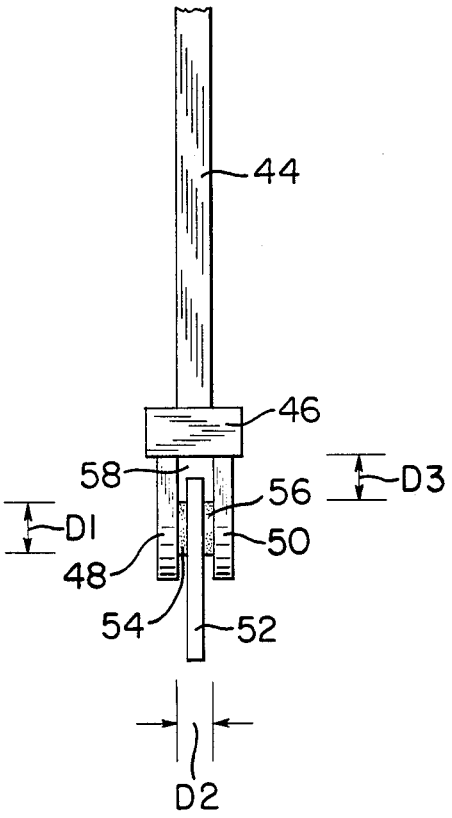
FIG. 8 is a side elevational view of the FIG. 7 suspenders.
Figure 7:
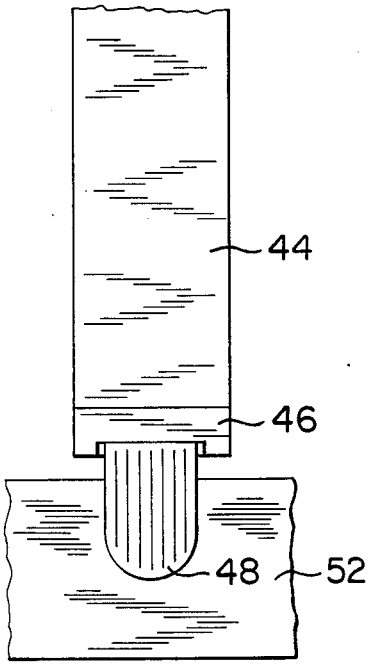
FIG. 7 is a partial front elevational view of suspenders of the snap type.

Turning to FIGS. 7 and 8, suspender straps 44, of known elastic structure in synthetic or natural cloth material, has a fitting 46 fixedly secured thereto and supporting jaws 48 and 50, typically of metal, for independent pivotal movement from open state for receipt of a trouser waistband 52 to closed state, as in FIG. 8, for retentive engagement with waistband 52. Gripping pads 54 and 56, typically of resilient synthetic material and of disc shape, are supported respectively on jaws 48 and 50 to frictionally engage waistband 52.

In the known suspenders of the FIGS. 7 and 8 type, jaws 48 and 50 may be mutually, releasably latched in such closed state or a snap clasping further jaw (not shown) may be included and pivotally supported by fitting 46 outboard of either jaw to latch with the opposite jaw. Such snap suspenders are generally of the type to which hanger 10 is addressed, and hanging thereof is effected in accordance with the invention without need for opening jaws 48 and 50, i.e., with the snap in closed state. Of consequence in this respect are the dimensions D1 (diameter) of pads 54 and 56, and the dimensions D2 and D3 of interior passage 58 existing between pads 54, 56 and fitting 46, as discussed below.

Returning to FIG. 1, a length asymmetry desirably exists as between bottom wall segments 32 and 34. The horizontally outward bottom wall segment 32 is thus shown to have horizontal length L1 and the horizontally inward bottom wall segment 34 is of length L2. As is seen, wall segment 34 has length more than one half of the total bottom wall length L3, e.g., length L2 is preferably at least twice the length L1.

Figure 6:
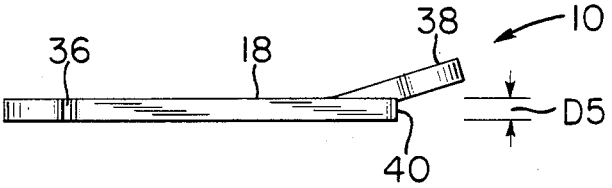
FIG. 6 is a bottom plan view of the FIG. 1 hanger in disposition for the receipt of a suspender snap.
Figure 5:
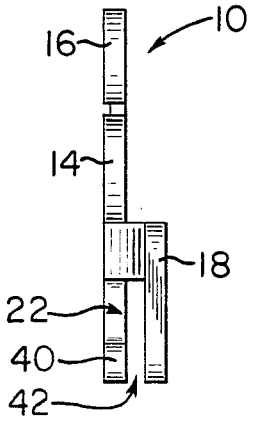
FIG. 5 is a side elevational view of the FIG. 1 hanger in disposition for the receipt of a suspender snap.
Figure 9:
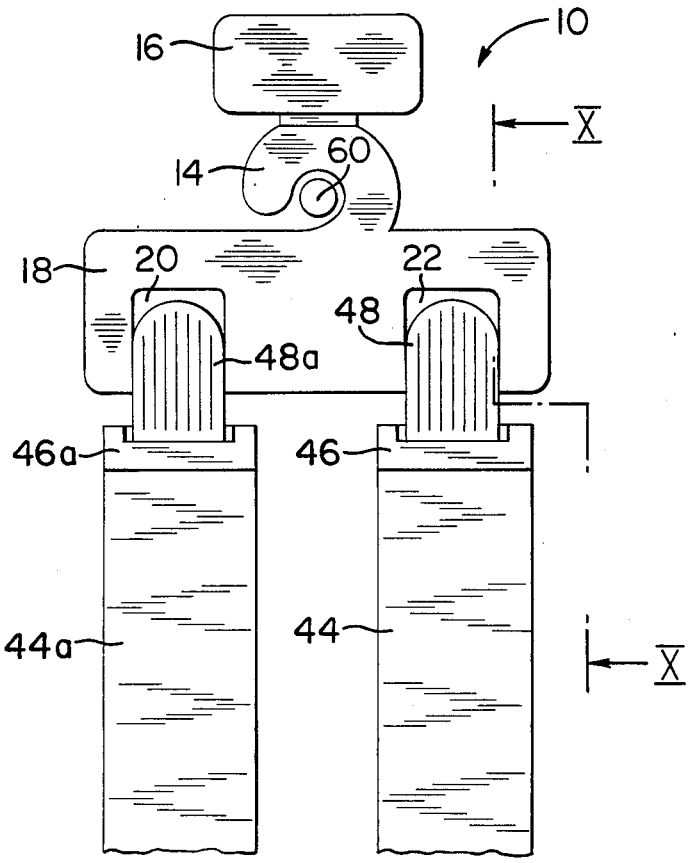
FIG. 9 is a front elevational view of the assembly of the FIG. 1 hanger and the FIG. 7 suspenders.
Figure 10:
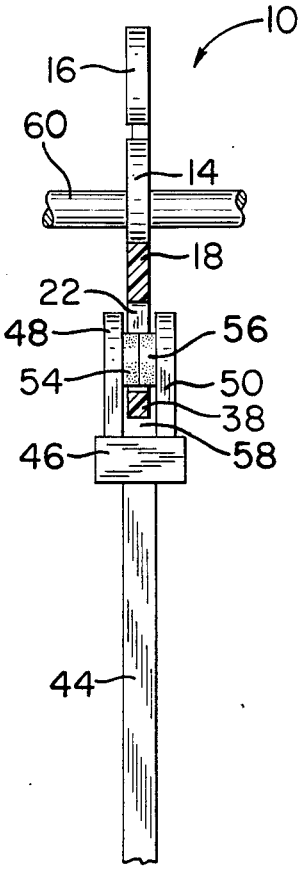
FIG. 10 is a partly-sectioned side elevational view of the FIG. 9 assembly as would be seen from plane X—X.

FIGS. 5 and 6 depict hanger 10 with deflecting force applied to its rightward outboard extent, whereby such rightward outboard extent is displaced. This exposes the end of bottom wall segment 40 and opening 22 sidewardly of hanger 10, permitting movement of wall segment 40 into residence in passage 58, and movement of pads 54 and 56 into residence in opening 22, without requiring the movement of jaws 48 and 50 to open state. The deflected portion of hanger 10 is now reversely deflected and bottom wall segment 38 also becomes resident in passage 58, in normal alignment with bottom wall segment 40, as is shown in FIG. 10, wherein hanger 10 is disposed hanging the suspenders from display rod 60. A second suspender strap **44*a* is shown in FIG. 9, with its associated fitting 46*a* and jaw 48*a*, having its pads disposed in opening 20**.

The assembly thus attained is effected by selecting hanger opening dimensions L3 and D4 each to be at least as large as pad diameter D1, and by selecting the dimensions D5 and D6 of the bottom wall segments to be equal to or less than the corresponding dimensions D2 and D3 of passage 58.

Figure 11:
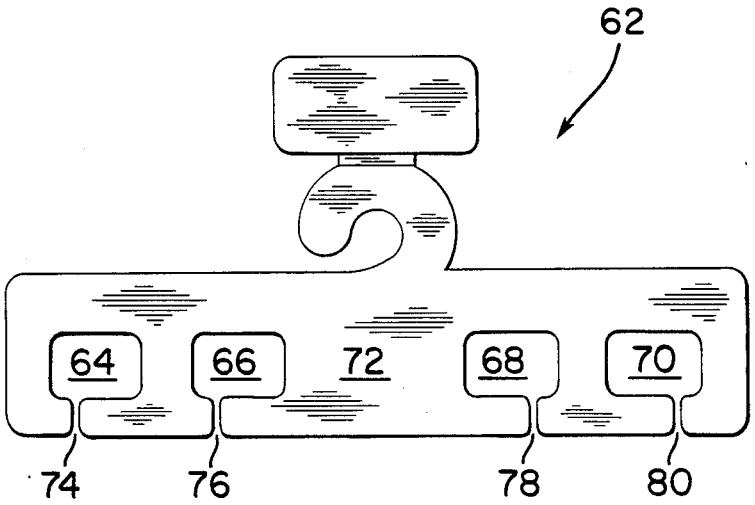
FIG. 11 is a front elevational view of a second embodiment of the hanger of the invention.
Figure 12:
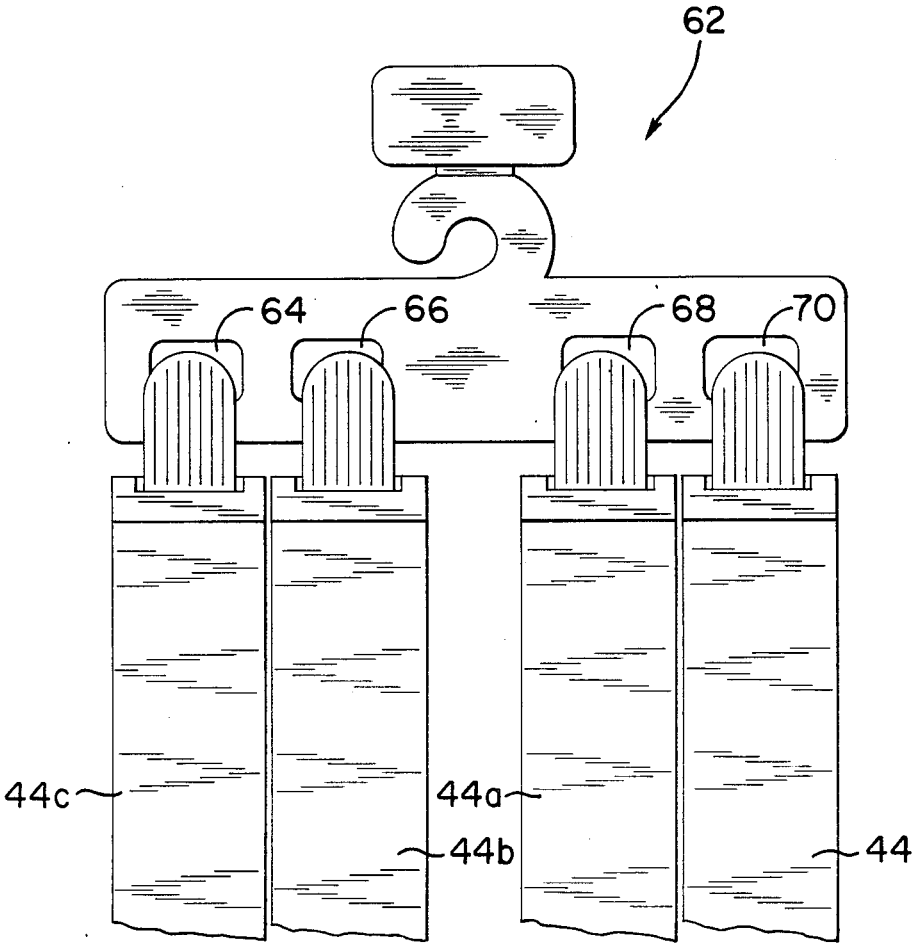
FIG. 12 is a front elevational view of the assembly of the FIG. 11 hanger and suspenders.

Turning now to FIG. 11, a second embodiment of a hanger 62 in accordance with the invention has openings 64, 66, 68 and 70 aside central expense 72. Each opening is bounded again in first part by continuous hanger body expanse and in second part by a discontinuity in the hanger body, providing passages 74, 76, 78 and 80 into the openings. As is seen in FIG. 12, hanger 62 is thus suited for the hanging of all straps, 44, **44*a*, 44*b* and 44*c***, of a given suspenders.

As will be appreciated, the asymmetrical lengths of the bottom wall segments bounding the suspender hanging openings, one segment being preferably more than twice the length of the other thereof, enhance retention of the suspender snap friction pads, since the passage into each such opening is off-center with respect to the pad center when the assembly is effected.

Various changes in structure and modifications in practice may be introduced without departing from the invention. The particularly depicted preferred embodiments and described practices are accordingly intended in a descriptive and not in a limiting sense. The true spirit and scope of the invention is set forth in the following claims.

What is claimed is:

1. In combination, suspenders of the type having snap means in first open state for receiving the waistband of trousers and in second closed state for closure retentively upon said waistband and a hanger hanging said suspenders and comprising an integral body having a first portion for engaging a display rod, and a second portion depending from said first portion and defining at least one pair of openings therethrough, each said opening being bounded in first part by continuous wall structure of said body and in second part by a discontinuity in said body providing a passage into said opening, first and second segments of the said wall structure respectively aside the passage being mutually deflectable, permitting the receipt in said opening of said suspender snap means in such closed state thereof.

2. The invention claimed in claim 1 wherein each said snap means includes a pair of jaws supported for movement into closed state, said jaws having respective gripping members brought into mutual engagement upon such closure of said jaws, said openings being of dimensions exceeding the dimension of said gripping members.

3. The invention claimed in claim 2 wherein said jaws define a passage therethrough interiorly adjacent said gripping members, said first and second wall structure segments having dimensions less than the dimension of such jaw passage.

4. The invention claimed in claim 1 wherein said openings are generally rectangular, said first and second wall structure segments jointly constituting one side of such rectangle.

5. The invention claimed in claim 4 wherein said first and second wall structure segments are of respective different lengths.

6. The invention claimed in claim 5 wherein said first wall structure segment is of length more than twice the length of said second wall segment.

7. The invention claimed in claim 1 wherein said second hanger portion is of rectangular configuration with its longer dimension horizontal, said openings being two in number and each of rectangular configuration, said second hanger portion defining a solid central expanse between said openings, said first and second wall structure segments for each such opening extending horizontally therebelow.

8. The invention claimed in claim 7 wherein such second wall structure segment for each said opening is horizontally outward of such first wall structure segment thereof, said first wall structure segment being of length at least twice the length of said second wall structure segment.

* * * * *

Disclaimer 4,759,440.—*Chester Kolton*, Westfield; *Stuart S. Spater*, Livingston, both of N.J. HANGER FOR SUSPENDERS WITH TROUSER SNAPS. Patent dated July 26, 1988. Disclaimer filed Jan. 9, 1989, by the assignee, *B&G Plastics, Inc.*

Hereby enters this disclaimer to claims 1-8 of said patent.

[*Official Gazette March 7, 1989.*